US006538381B1

(12) United States Patent
Ueoka et al.

(10) Patent No.: US 6,538,381 B1
(45) Date of Patent: Mar. 25, 2003

(54) PLASMA DISPLAY PANEL AND METHOD FOR MANUFACTURING THE SAME

(75) Inventors: Mitsuo Ueoka, Tokyo (JP); Hiroshi Shiba, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/536,142

(22) Filed: Mar. 28, 2000

(30) Foreign Application Priority Data

Mar. 30, 1999 (JP) ..... 11-090181

(51) Int. Cl.[7] ..... H01J 17/49

(52) U.S. Cl. ..... 313/582; 313/584; 313/485; 313/505

(58) Field of Search ..... 313/582, 583, 313/584, 586, 587, 485, 491, 505, 509

(56) References Cited

U.S. PATENT DOCUMENTS

| | | | | | |
|---|---|---|---|---|---|
| 5,900,694 | A | * | 5/1999 | Matsuzaki et al. | 313/484 |
| 6,013,983 | A | * | 1/2000 | Asano et al. | 313/581 |
| 6,137,227 | A | * | 10/2000 | Kim et al. | 313/582 |
| 6,169,363 | B1 | * | 1/2001 | Mori et al. | 313/582 |
| 6,172,461 | B1 | * | 1/2001 | Ha | 313/585 |
| 6,191,530 | B1 | * | 2/2001 | Fukuta et al. | 313/586 |
| 6,215,244 | B1 | * | 4/2001 | Kuribayashi et al. | 313/505 |
| 6,232,717 | B1 | * | 5/2001 | Oida et al. | 313/586 |
| 6,288,488 | B1 | * | 9/2001 | Amemiya | 313/582 |
| 6,337,538 | B1 | * | 1/2002 | Awaji et al. | 313/586 |

FOREIGN PATENT DOCUMENTS

| | | | |
|---|---|---|---|
| JP | 62286271 A | * | 12/1987 |
| JP | 10177845 A | * | 6/1998 |
| JP | 10233171 A | * | 9/1998 |
| JP | 11312470 A | * | 11/1999 |
| JP | 2000306517 A | * | 11/2000 |
| JP | 2001183999 A | * | 7/2001 |
| JP | 2001202891 A | * | 7/2001 |

* cited by examiner

*Primary Examiner*—Vip Patel
*Assistant Examiner*—Kevin Quarterman
(74) *Attorney, Agent, or Firm*—Sughrue Mion, PLLC

(57) ABSTRACT

A plasma display panel is provided which is capable of suppressing the degradation of the fluorescent material layer by discharge and which ensures a long service life. The plasma display panel is obtained by assembling and airtight sealing of a first substrate provided with a plurality of surface discharge electrode pairs arranged so as to form a matrix with a second substrate provided with separating walls and fluorescent material layers disposed so as to conform with said plurality of surface discharge electrode pairs, wherein electrodes of one side of each electrode pair in said plurality of surface discharge electrode pairs are connected to each line bus wire among a plurality of line bus wires formed extending along the line direction on said first transparent insulating substrate, and the electrodes of the other side of each electrode pair in said plurality of surface discharge electrode pairs are connected to each row bus wire among a plurality of row bus wires disposed along the row direction on said first transparent insulating substrate formed extending along the row direction on said first transparent insulating substrate.

12 Claims, 14 Drawing Sheets

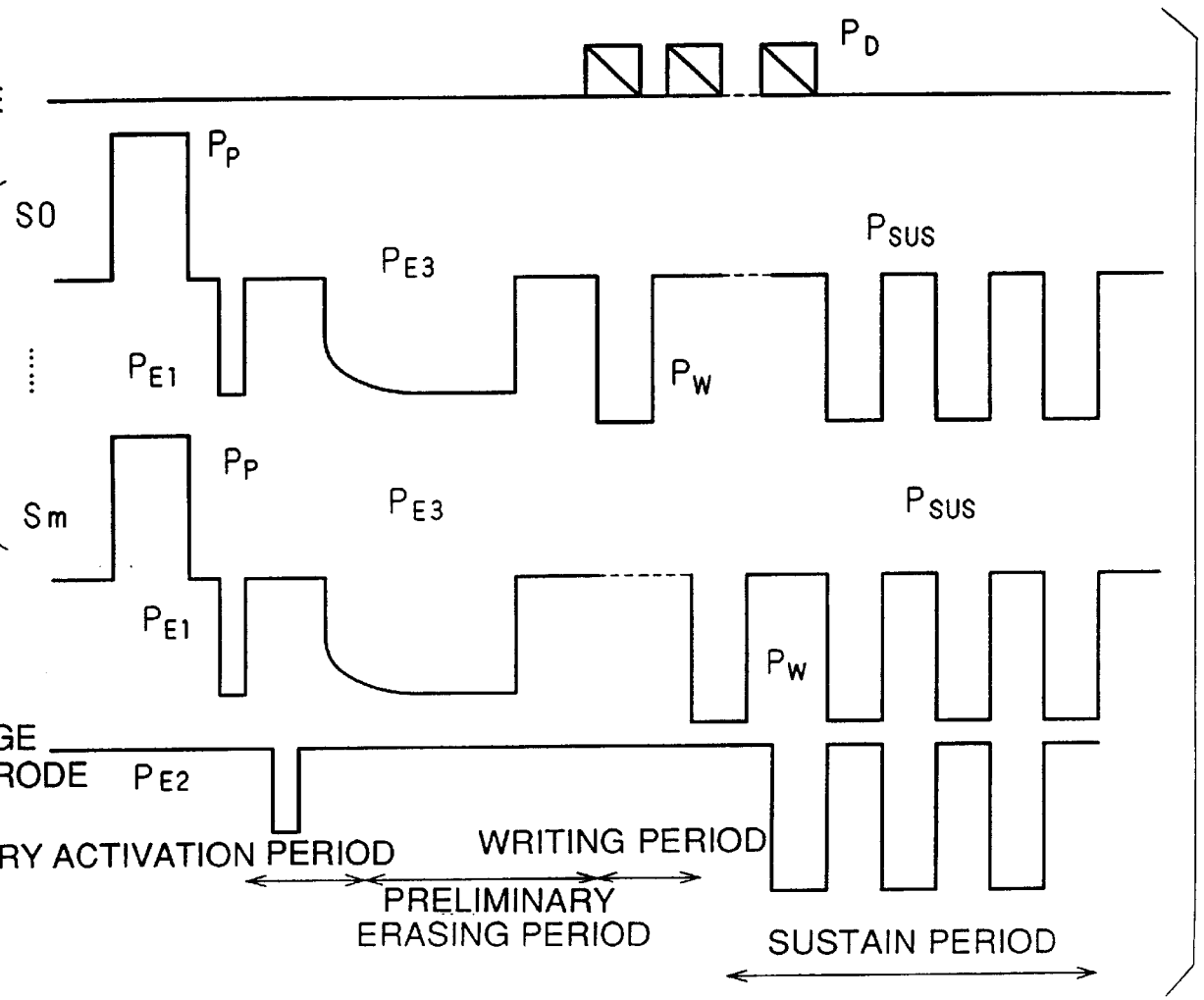
PRIOR ART Fig. 14A
APPLIED VOLTAGE TO DATA ELECTRODE
PRIOR ART Fig. 14B
APPLIED VOLTAGE TO SCANNING ELECTRODE
PRIOR ART Fig. 14C
APPLIED VOLTAGE TO SUSTAIN ELECTRODE
$P_D$
$P_P$
$P_{E1}$
$P_{E2}$
$P_{E3}$
$P_W$
$P_{SUS}$
S0
Sm
PRELIMINARY ACTIVATION PERIOD
WRITING PERIOD
PRELIMINARY ERASING PERIOD
SUSTAIN PERIOD

PLASMA DISPLAY PANEL AND METHOD FOR MANUFACTURING THE SAME

BACKGROUND OF THE INVENTION

1. Field of the Invention

The present invention relates to a plasma-display panel and a method for manufacturing the same, and particularly relates to a surface discharge-type plasma display panel and a method of manufacturing therefor.

2. Background Art

A plasma display panel is a display device utilizing a gas discharge luminescence in inert gases such as neon or xenon. In the conventional plasma display panel, a two counter electrode discharge-type structure has been adopted, in which the image is displayed by selective discharge between intersecting portions of counter electrodes, one of which is a series of line electrodes formed on one panel plate, and the other of which is a series of row electrodes formed on the other panel plate. A typical structure of such a conventional two electrode type plasma display panel is shown in FIG. 12. In FIG. 12, a front plate 100 and a rear plates 102 using two glass plates are arranged so as to face each other. A plurality of line discharge electrodes 104 are formed on the front plate 100, and a plurality of row discharge electrodes 108 are formed on the back plate 102, in the direction that crosses the line discharge electrodes 104 at a right angle. A dielectric layer 106 is formed so as to cover the line discharge electrodes 104.

On the back plate 102, separating walls 110 are formed in the direction of the line discharge electrodes so as to partition the row discharge electrodes, and fluorescent material layers 112 are formed to cover the side surfaces of the separating walls as well as the row discharge electrodes 108. A discharge space 114 is filled with the discharge gas such as neon. In the above-described structure, a desired image is displayed by plasma luminescence by selective discharge of the line discharge electrodes 104 or the row discharge electrodes 108.

The above-described two-electrode-type plasma display panel has been used for monochromatic display. Recently, however, an essential requirement for the color display necessitates conversion of the ultraviolet light generated by the discharge into three visible light and formation of the three fluorescent material coatings in the discharge space. When such coatings are formed in the counter discharge-type panel, the fluorescent material films are likely to be bombarded by charged particles, so that degradation of the fluorescent materials results in short service life.

A new plasma display panel, proposed as a solution to the above-described problem, is a surface discharge-type plasma display panel, in which discharge takes place separated from the fluorescent materials, and the surface discharge-type has recently become the leading plasma display panel. In general, the surface discharge-type plasma display panel uses parallel electrode pairs comprising a scanning electrode and a sustain electrode and as well as a data electrode is disposed in the direction crossing the scanning and sustain electrodes at a right angle, so that this type of plasma display panel is called a three electrode surface discharge-type panel. The schematic structure of the three electrode surface discharge-type plasma display panel is illustrated in FIG. 13. As illustrated, this type of plasma display panels is constituted by a front insulating glass plate 60 disposed at the front side facing a back insulating glass plate 62 disposed at the back side, leaving a discharge space 80 therebetween.

On the front plate 60, the surface discharge electrode pairs comprising the scanning electrodes 72*a* and sustain electrodes 72*b* made of transparent films such as ITO or nesa films are formed. In addition, a trace electrode 74 made of metal is formed on the scanning and the sustain electrodes in order to reduce the resistance of those scanning and sustain electrodes. The trace electrode 74 is usually formed by a laminated thin film electrode made of Cr/Cu/Cr or the thick film electrode made of Ag.

Furthermore, these electrodes are covered by a dielectric layer 64. The dielectric layer 64 is usually formed using a low-melting glass. A protective film made of MgO (not shown) is formed on the dielectric film 64 in order to prevent the damage due to ions or plasma generated by the discharge and to reduce the discharge voltage as well.

On the back plate 62, the scanning electrode 72*a* and a data electrode 72*b*, made by a thick film of Ag are formed in the direction perpendicular to the sustain electrode 72*b*. Subsequently, on the data electrodes, a white dielectric film 68 is formed by printing and firing a glass paste made by mixing white oxide materials (alumina or titanium oxide) and a low-melting glass powder on the data electrode 78. This white dielectric layer 68 is used for reflecting visible light from the fluorescent material in order to enhance the efficiency of the emission of visible light. Furthermore, on this white dielectric layer 68, three types of fluorescent materials 70 are separately coated by thick film technology for converting the ultraviolet light due to the gas discharge into three types of visible light, R (red), G (green) and B (blue).

The front plate 60 and the back plate 62 are disposed facing each other enclosing separating walls (not shown) formed by an insulating material in matrix or stripe forms for forming discharge cells 76, and a discharge gas, constituted by helium, neon, xenon or a mixture of these gases, is filed in the discharge space 80. The above separating walls are formed by the thick film technology using a mixture of the low-melting glass with alumina, magnesium oxide, titanium oxide etc.

Hereinafter, the discharge operation of a selected discharge cell 76 will be described with reference to FIG. 14. First, in the preliminary discharge period, a preliminary discharge pulse PP is applied to the scanning electrodes 72*a* over the entire display surface area for generating discharge between the scanning electrodes 72*a* and the sustain electrodes 72*b*. Subsequently, in the elimination period for eliminating wall charges generated on the scanning electrode 72*a* and the sustain electrode 72*b*, a pulse train PE1, PE2, and PE3 is applied to the scanning electrode 72*a* and the sustain electrode 72*b*, respectively. In the writing period, a writing pulse PW is applied so as to scan all scanning electrodes 72*a* in sequence. In synchronism with the writing pulse PW, a data pulse PD in accordance with the desired display data is applied to the data electrode 78 for causing discharge between the scanning electrode and the data electrode.

Next, in the sustain period, the charge generated in the writing period is maintained as the surface discharge by applying a voltage pulse PSUS to both sustain electrodes 72*a* and 72*b* for the display. The above preliminary period and the elimination period play a role to produce reliably the discharge between the scanning electrode 72*a* and the data electrodes 78 corresponding to the display data generated in the writing period succeeding the preliminary period and the elimination period. Accordingly, the strong surface discharge over the entire surface followed by the weak discharge allows eliminating the wall charge on the electrodes forming the discharge cells as well as leaving the space charge due to the ionized particles in the discharge cells.

In the writing period, the discharge caused between the scanning electrode 72*a* and the data electrodes 78 forms the positive wall charge on the scanning electrodes 72*a* and the negative wall charge on the data electrode 78. When these wall charges are present, since these wall charges overlap with the pulse PSUS applied to the scanning electrode 72*a* and the sustain electrode 72*b,* it becomes possible to generate and maintain the surface discharge in discharge cells corresponding to the display data because the applied voltage exceeds the surface discharge starting voltage.

As described above, the conventional AC memory-type color plasma display panel uses a discharge between the scanning electrode 72*a* and the data electrode 78 facing each other for writing the display data. However, although the scanning electrode 72*a* is covered by a good discharge resistant material such as magnesium oxide, the data electrode 78 is covered by the fluorescent material 70. Thus, the voltage at the time of the writing discharge is applied such that the potential of the scanning electrodes 72*a* becomes more negative than the potential of the data electrodes 78. The objective of such potential application is to prevent degradation of the brightness due to the surface damage of the fluorescent material by suppressing collision of heavy positive charged ions which are likely to cause deterioration of the fluorescent material due to sputtering. Another objective is to prevent the brightness degradation and the change of the discharge voltage by scattering and adhesion of the sputtered fluorescent material layer 70.

However, even if the above measures are taken, there is a possiblility that a weak discharge is caused in the preliminary discharge period, in the erasing period, and in the writing period, at the time when the potential of the data electrode 78 is lower than the potential of the scanning electrode, and degradation of the brightness or the change of the discharge voltage are caused because the electron bombardment also damages the fluorescent material. Therefore, the problem arises that the brightness of a continuously lighting portion deteriorates sooner than the other portion when a fixed letter is continuously displayed. The same problem is likely to be caused such that degradation of the brightness for the primary colors differs from each other, and an inhomogeneous spot in the luminescence brightness, or so-called burning, results. The other problem is that the service life of the plasma discharge panel is not sufficient.

Japanese Patent Application, First Publication No. Sho 57-15340 discloses an AC-type plasma display panel, in which a matrix type electrodes crossing at a right angle through a dielectric layer is provided and the discharge luminescence for the display is generated at these intersecting points. This plasma display panel is not practical because it has the problems in that it is difficult to obtain sufficient insulation between electrodes at the intersecting portions and that the discharge voltage increases if the thickness of the insulating layer between two electrodes increases for sufficient insulation.

Japanese Patent Application, First Publication No. 5-101781 discloses a plasma display panel, which, on one hand, displays by the discharge luminescence generated at intersecting points of stereoscopic electrodes provided on the separating walls on the back plate, and which, on the other hand, controls the discharge by providing a trigger electrode (the third electrode) formed on the front plate. A problem arises in this type of plasma display panel that, since the fluorescent material layer is formed on the trigger electrode on the front plate, the fluorescent material layer is likely to deteriorate because of the discharge between the trigger electrode and the other electrodes on the back plate.

Those conventional plasma display panels have the common problem that the fluorescent material layer is exposed to the plasma discharge and it has been difficult to suppress the deterioration of the fluorescent material layer, even though those panels have the structure similar to the present invention in that the matrix type electrodes crossing each other at a right angle are formed and that the electrodes are formed on the separating walls.

If a plasma display panel can be provided based the luminescence due to the surface discharge by two electrode-type driving circuit constitution, it would be advantageous in achieving a plasma display device provided with a long service life by a simple driving sequence.

SUMMARY OF THE INVENTION

It is therefore an objective of the present invention to provide an plasma display panel and a method of manufacturing the same which has a long service life by suppressing deterioration of the fluorescent material layer.

According to the first aspect of the present invention, the plasma display panel obtained by the assembling and airtight sealing of a first substrate provided with a plurality of surface discharge electrode pairs formed by use of a conductive material arranged so as to form a matrix with a second substrate provided with separating walls and fluorescent material layers disposed so as to conform with said plurality of surface discharge electrode pairs, wherein the electrodes of one side of each electrode pair in said plurality of surface discharge electrode pairs are connected to each line bus wire among a plurality of line bus wiring formed extending along the line direction on said first substrate, and the electrodes of the other side of each electrode pair in said plurality of surface discharge electrode pairs are connected to each row bus wire among a plurality of row bus wires disposed along the row direction on said second substrate formed extending along the row direction on said first transparent insulating substrate.

According to the second aspect, in the plasma display panel according to the first aspect, the separating wall comprises a wall portion at least extending along the row direction and each electrode on the other side among a plurality of surface discharge electrode pairs is connected individually with said row bus wire by means of a connecting means including a plurality of transfer electrodes formed in said separating wall.

According to the third aspect, in the plasma display panel according to the second aspect, the mutually opposing end sides of two surface discharge electrodes constituting each of said surface discharge electrode pairs are disposed leaving a space from said separating wall.

According to the fourth aspect, in the plasma display panel according to the second aspect, along a direction along either the line direction or the row direction of said first transparent insulating substrate, said surface discharge electrode pair is partitioned by a black mask formed so as to intervene between an upper portion of the separating wall and said first transparent insulating substrate.

According to the fifth aspect, in the plasma display panel according to the fourth aspect, the mutually opposing end sides of two surface discharge electrodes constituting each of said surface discharge electrode pairs are disposed leaving a space from said black mask.

According to the sixth aspect, in the plasma display panel according to the third aspect, said space between the mutually opposing end sides of two surface discharge electrodes constituting each of said surface discharge electrode pairs is within a range of 20 to 150 $\mu$m.

According to the seventh aspect, in the plasma display panel according to the second aspect, separating walls are formed in the form of stripes on said second insulating substrate, and fluorescent material layers are formed on the area of said second insulating substrate between said separating walls in the form of stripes including side surfaces of said separating walls.

According to the eighth aspect, in the plasma display panel according to the second aspect, said connecting means comprises a connecting electrode formed on said first transparent insulating film and a transfer electrode formed on said second insulating substrate, wherein said surface discharge electrode of one side of said surface discharge electrode pair is connected to said connecting electrode and said connecting electrode is electrically connected to said transfer electrode.

According to the ninth aspect, in the plasma display panel according to the second aspect, a pad electrode pattern is formed on each transfer electrode or on the connecting electrode, and wherein said pad electrode layer is composed of a material which can be melted and deformed simultaneously during the airtight sealing process of said first transparent insulating substrate and said second insulating substrate.

According to the tenth aspect, in the plasma display panel according to the eighth aspect, said connecting electrode and said transfer electrode are coupled by capacitive coupling intervening a dielectric layer.

According to the eleventh aspect, in the plasma display panel according to the tenth aspect, said dielectric layer has a capacity 100 times larger than that of the space between the one and the other electrodes of said surface discharge electrode pair.

According to the twelfth aspect, the method for manufacturing a plasma display panel at least comprises the steps of forming a plurality of surface discharge electrode pairs by a transparent conductive material so as to form a matrix on the first transparent insulating substrate; forming separating walls on the second insulating substrate; and forming fluorescent layers on the side walls and the bottom portions of said separating walls; wherein said step of forming separating walls comprises the steps of: forming the row bus wiring on the locations where the separating wall is formed; and forming in said separating walls transfer electrodes connected to said row bus wiring.

According to the thirteenth aspect, the method for manufacturing a plasma display panel at least comprises the steps of: forming a plurality of surface discharge electrode pairs made of a transparent conductive material so as to form a matrix on the first transparent insulating substrate; forming separating walls on the second insulating substrate; and forming fluorescent material layers on the side surfaces and bottom portions of said separating walls; wherein said pad electrode layer pattern formed on said second insulating substrate is connected with said connecting electrodes on said first transparent insulating substrate by softening and melting said pad electrode layer pattern during airtight sealing by use of a low-melting glass at the periphery of the assembled first transparent insulating substrate and the second insulating substrate while facing each other enclosing the separating walls.

According to the fourteenth aspect, in the method for manufacturing a plasma display panel according to the twelfth aspect, the method comprising: a first step of attaching a separating wall paste to the side surface of recessions of a photosensitive resin form, formed by patterning the photosensitive resin in a similar configuration to the desired separating wall pattern on said row bus wiring, by forcing the separating wall paste into the above recessions; a second step of filling the electrode paste in predetermined locations in the recessions of the photosensitive resin for forming the transfer electrodes after drying the separating wall paste adhering to the side surface of the recessions of the photosensitive resin form formed by said first step; and a third step of filling the separating wall paste in the recessions of the photosensitive resin form using a selective pattern so as to prevent adhering to said transfer electrode surface.

According to the fifteenth aspect, in said first step of the method for manufacturing a plasma display panel according to the fourteenth aspect, the separating wall paste selectively attached to the side surface of the recessions of the photosensitive resin form by filling up the separating wall paste having a viscosity of 500 to 1500 centipoise in the recession of the photosensitive resin form.

According to the sixteenth aspect, in the third step of the method for manufacturing a plasma display panel according to the fourteenth aspect, the separating wall paste is filled in the recessions of the photosensitive resin form by the use of a screen, which comprises intermittently formed rectangular patterns formed in one direction along said second insulating film so as to prevent adhering of the separating wall paste to the upper surface of the transfer electrodes.

According to the seventeenth aspect, the method for manufacturing a plasma display panel according to the fourteenth aspect further comprises the fourth step for forming pad electrodes on the transfer electrodes after completion of the third step by printing the electrode paste using a screen provided with a dotted pattern for forming pad electrodes.

According to the eighteenth aspect, the method for manufacturing a plasma display panel according to the fourteenth aspect further comprising the fifth step for forming pad electrodes on the transfer electrodes after completion of the third step by printing the electrode paste into a dotted pattern using a dispenser.

According to the nineteenth aspect, in the method for manufacturing a plasma display panel according to the seventeenth aspect, the paste for forming said transfer electrodes and the paste for forming the pad electrodes are metallic pastes, and the softening temperature of the paste for forming said transfer electrode is lower than that of the paste for forming said pad electrode.

According to the twentieth aspect, in the method for manufacturing a plasma display panel according to claim 13, said pad electrodes and said connecting electrodes are connected by the use of an electrode paste, the softening temperature of which is approximately 50° C. lower than the softening temperature of the low-melting glass paste used at the time for carrying out airtight sealing of the periphery of the assembly in which said first transparent insulating substrate faces said second insulating substrate, with said separating walls interposed therebetween.

The plasma display panel according to the present invention displays a desired luminescent pattern, while scanning the surface discharge electrode on one side of the surface discharge electrode pairs, by use of the wall charge accumulated on the surface discharge electrodes on the other side of the surface discharge electrode pairs by applying a voltage corresponding to display data to said surface discharge electrodes.

The method of manufacturing the plasma display panel according to the present invention allows forming matrix in the horizontal and perpendicular directions by forming wiring for connecting to each electrode of the surface discharge electrode pairs on the other substrate.

BRIEF DESCRIPTION OF THE DRAWINGS

FIGS. 14A, 14B and 14C are diagrams showing driving voltages at respective electrodes of the conventional plasma display device shown in FIG. 12.

DETAILED DESCRIPTION OF THE INVENTION

Figure 1:
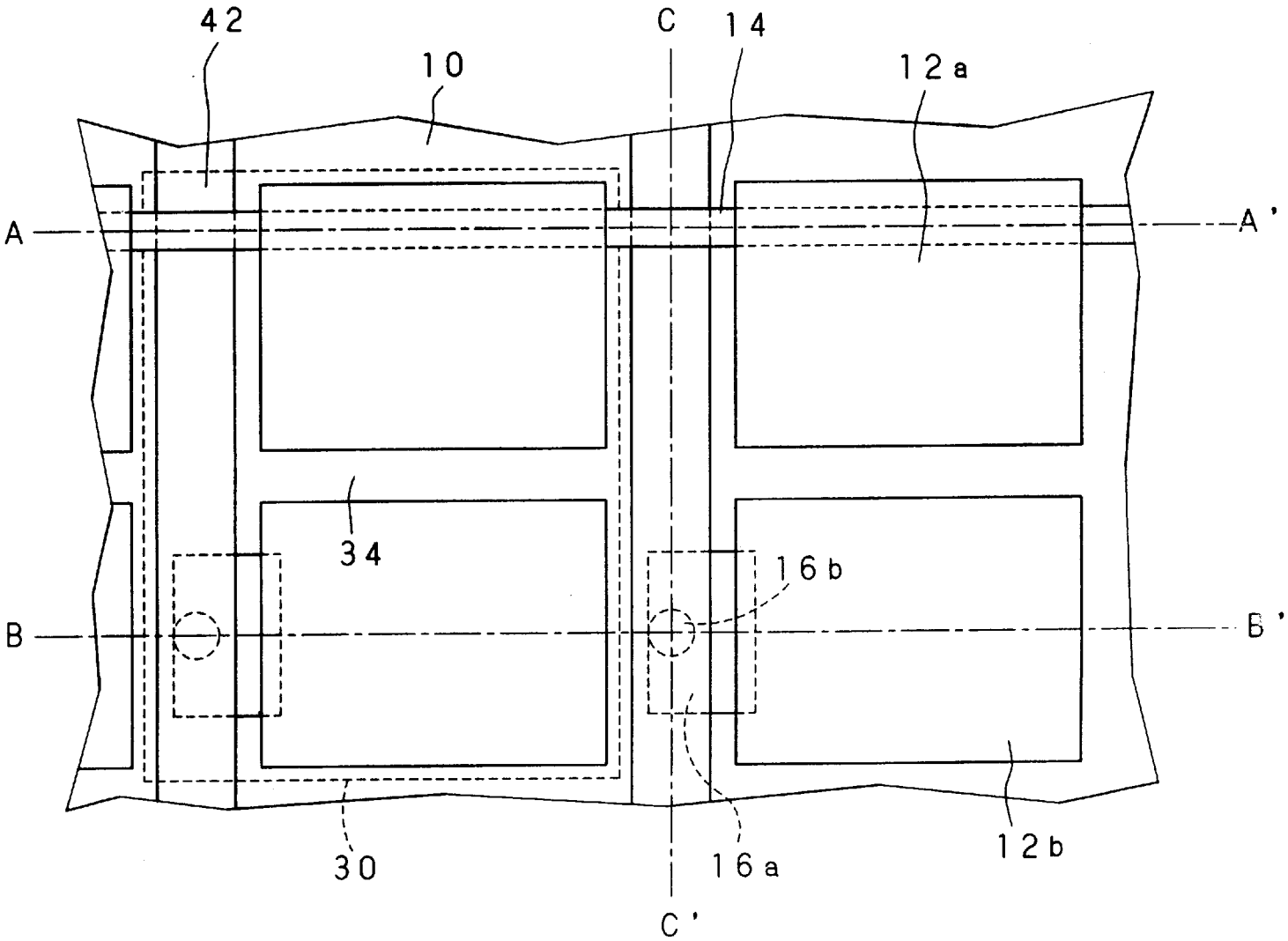
FIG. 1 is a plan view showing a structure of a plasma display panel according to the first embodiment of the present invention.
Figure 2:
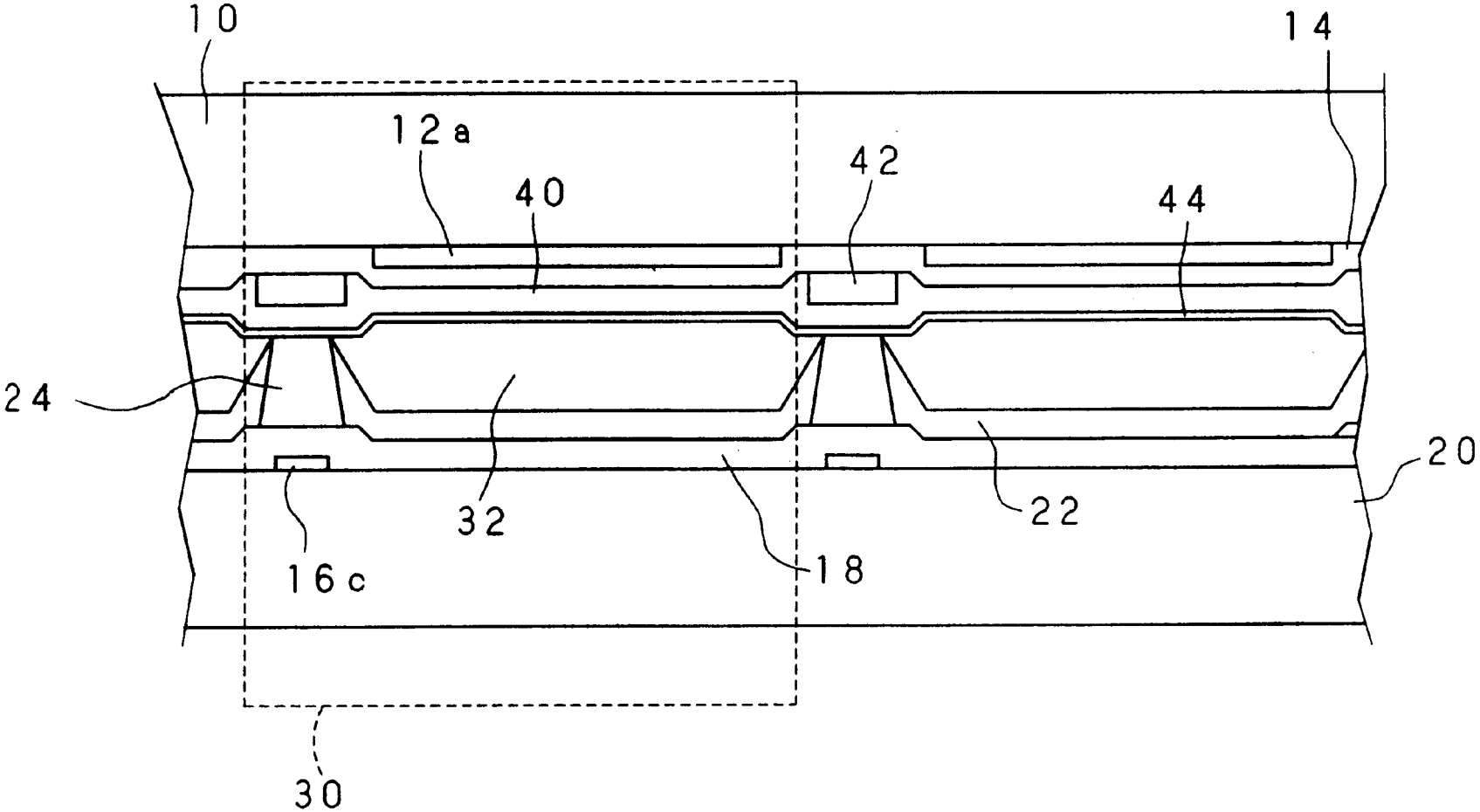
FIG. 2 is a cross-sectional view along the A–A' line of the first embodiment shown in FIG. 1.
Figure 3:
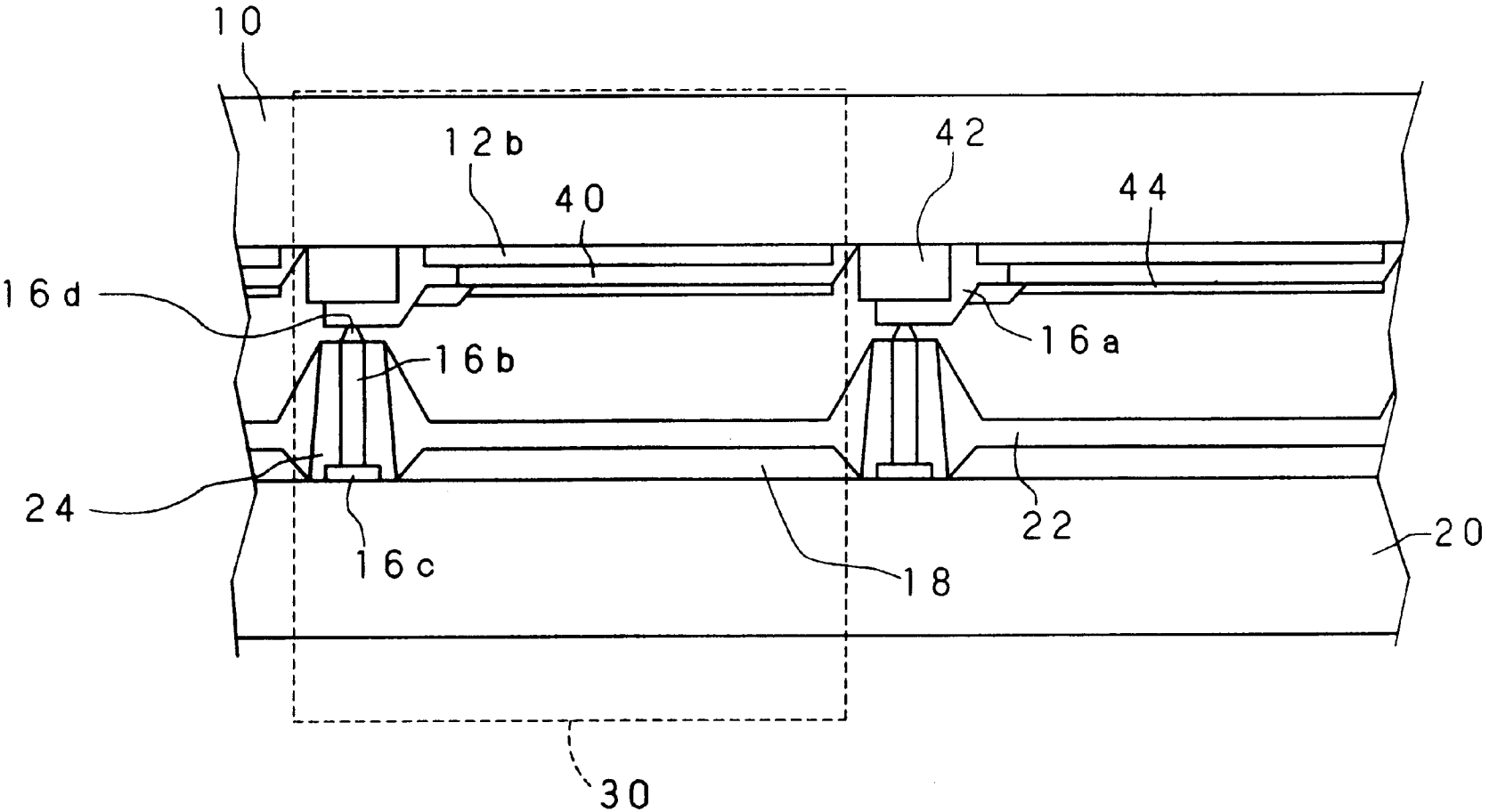
FIG. 3 is a cross-sectional view along the B–B' line of the first embodiment shown in FIG. 1.
Figure 4:
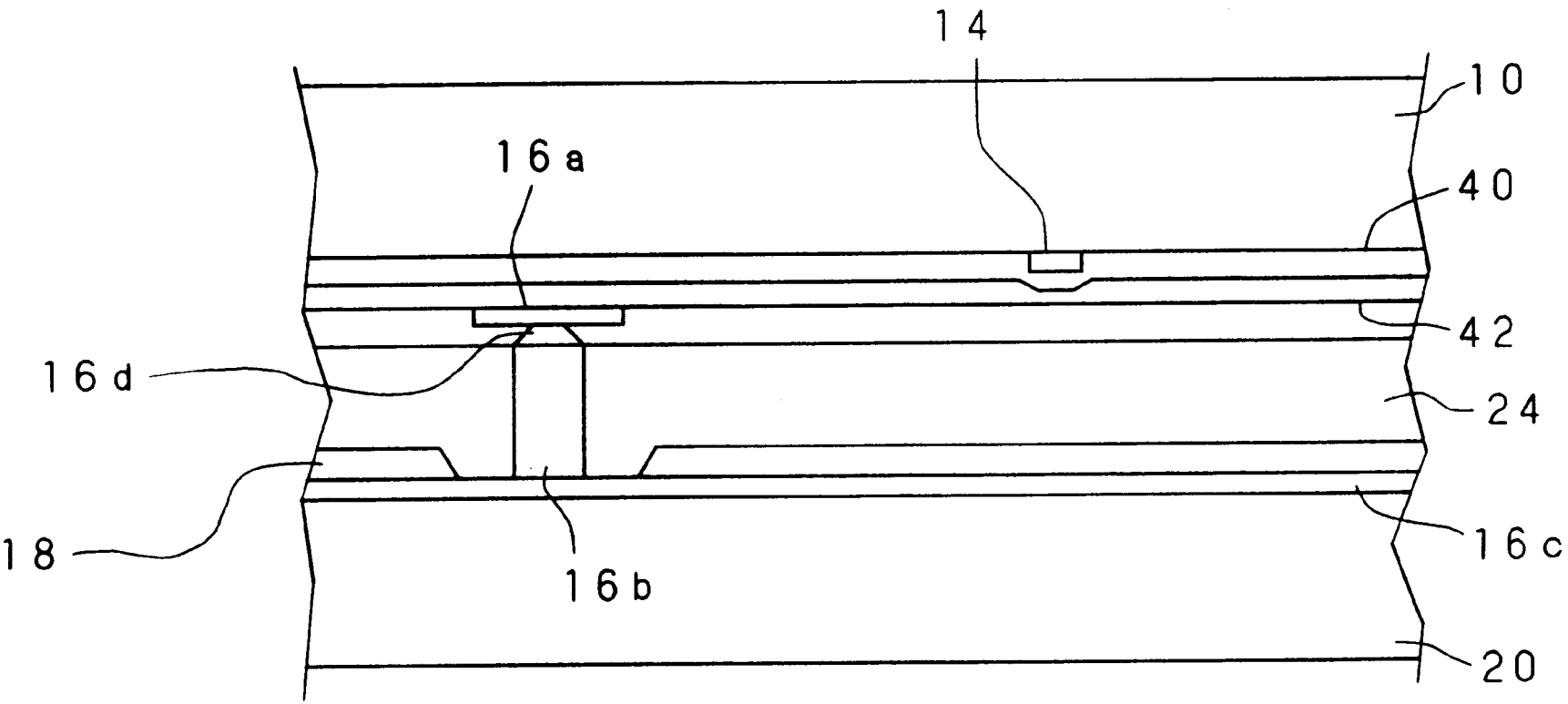
FIG. 4 is a cross-sectional view along the C–C' line of the first embodiment shown in FIG. 1.

Hereinafter, the plasma display devices according to the first embodiment of the present invention will be described with reference to the attached drawings. The structure of the plasma display device according to the first embodiment of the present invention is shown in FIGS. 1 to 4. FIG. 1 is a plan view showing a structure of a plasma display panel according to the first embodiment of the present invention. FIG. 2 is a cross-sectional view along the A–A' line of the first embodiment shown in FIG. 1. FIG. 3 is a cross-sectional view along the B–B' line of the first embodiment shown in FIG. 1. FIG. 4 is a cross-sectional view along the C–C' line of the first embodiment shown in FIG. 1. In these figures, the plasma display panel according to the first embodiment of the present invention comprises a front substrate 10 as the first transparent insulating plate and a back substrate 20 as the second transparent insulating plate, and these two insulating plates are arranged so as to face each other enclosing a discharge space 32 defined by the separating wall 24 interposed therebetween and tightly sealed.

On the front substrate 10 on the side having the discharge space 32, a plurality of pairs of line discharge electrodes 12*a* and row electrodes 12*b* are formed by a transparent conductive material in a form defining unit discharge cells 30, so as to form surface discharge electrode pairs for applying a discharge voltage for writing and displaying data. The line discharge electrodes 12*a* and the row discharge electrodes 12*b* are formed enclosing a discharge gap 34 having a predetermined thickness. On the side facing the discharge space 32 of the back substrate 20, a fluorescent material layer 22 and a separating wall 24 are formed, and a specific structure is adopted so as to cause selective discharge for a unit cell by selectively activating a specific pair of line and row discharge electrodes out of a plurality of pairs of line discharge electrodes 12*a* and row discharge electrodes 12*b*.

Each line of the line discharge electrodes 12*a* constituting one of a plurality of the surface discharge electrodes is connected to the line bus 14 formed in the line direction of the front substrate 10, and each row of the row discharge electrodes 12*b* constituting one of a plurality of the surface discharge electrodes connected to the row bus wire 16*c* formed in the raw direction of the back substrate 20.

Furthermore, each of the row discharge electrodes 12*b* constituting the plurality of surface discharge electrode pairs is connected with the row bus wiring 16*c* by means of connecting means including a plurality of transfer electrodes 16*b* formed in the separating wall.

The connecting means includes connecting electrodes formed on the front substrate 10 and transfer electrodes formed on the back substrate 20. The line discharge electrodes 12*a* are connected to the connecting electrode 16*a*, the connecting electrode is connected to the transfer electrodes 16*b*, and the transfer electrodes 16*b* are connected to the row bus line.

In the first embodiment of the present invention, the above connecting means also comprises pad electrodes 16*d* besides the connecting electrodes 16*a* and the transfer electrodes 16*b*, and the connecting electrodes 16*a* are electrically connected to the transfer electrodes 16*b* through the pad electrodes 16*d*.

Figure 5:
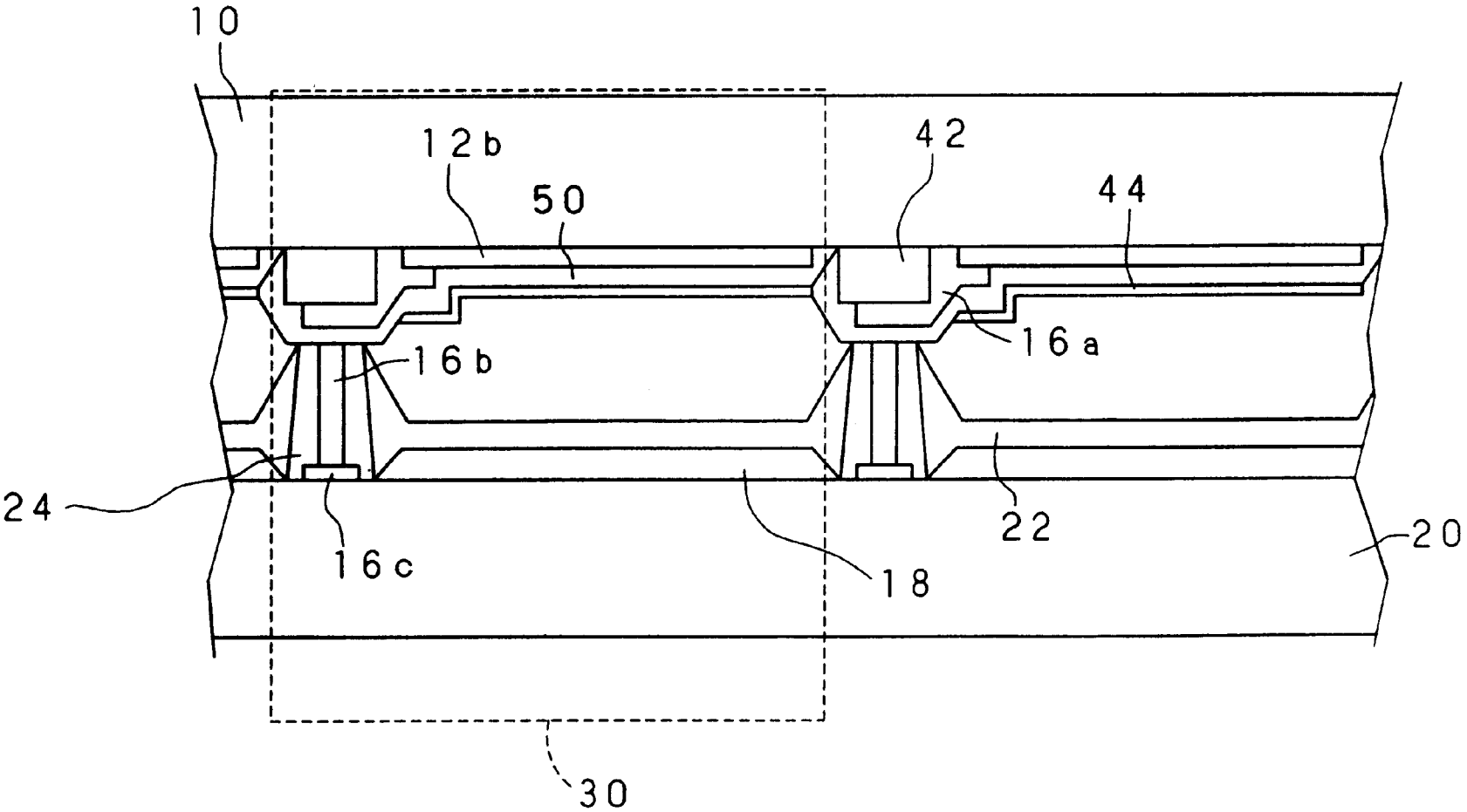
FIG. 5 is a plan view showing a structure of a plasma display panel according to the second embodiment of the present invention.

FIG. 5 is a plan view showing a structure of a plasma display panel according to the second embodiment of the present invention. A diagram shown in FIG. 5 corresponds to a cross-sectional diagram along the B–B' line of FIG. 1. The plasma display panel according to the second embodiment differs from that according to the first embodiment in that the connecting electrodes 16*a* and the transfer electrodes 16*b* are coupled by a capacitor coupling. That is, a transparent dielectric layer 50 is formed between the connecting electrodes 16*a* and the transfer electrodes 16*b* and the connecting electrodes 16*a* and the transfer electrodes 16*b* are connected through a capacitor. The other structural elements of the second embodiments are the same as those of the first embodiment, and explanations of those structural elements are omitted.

Figure 6:
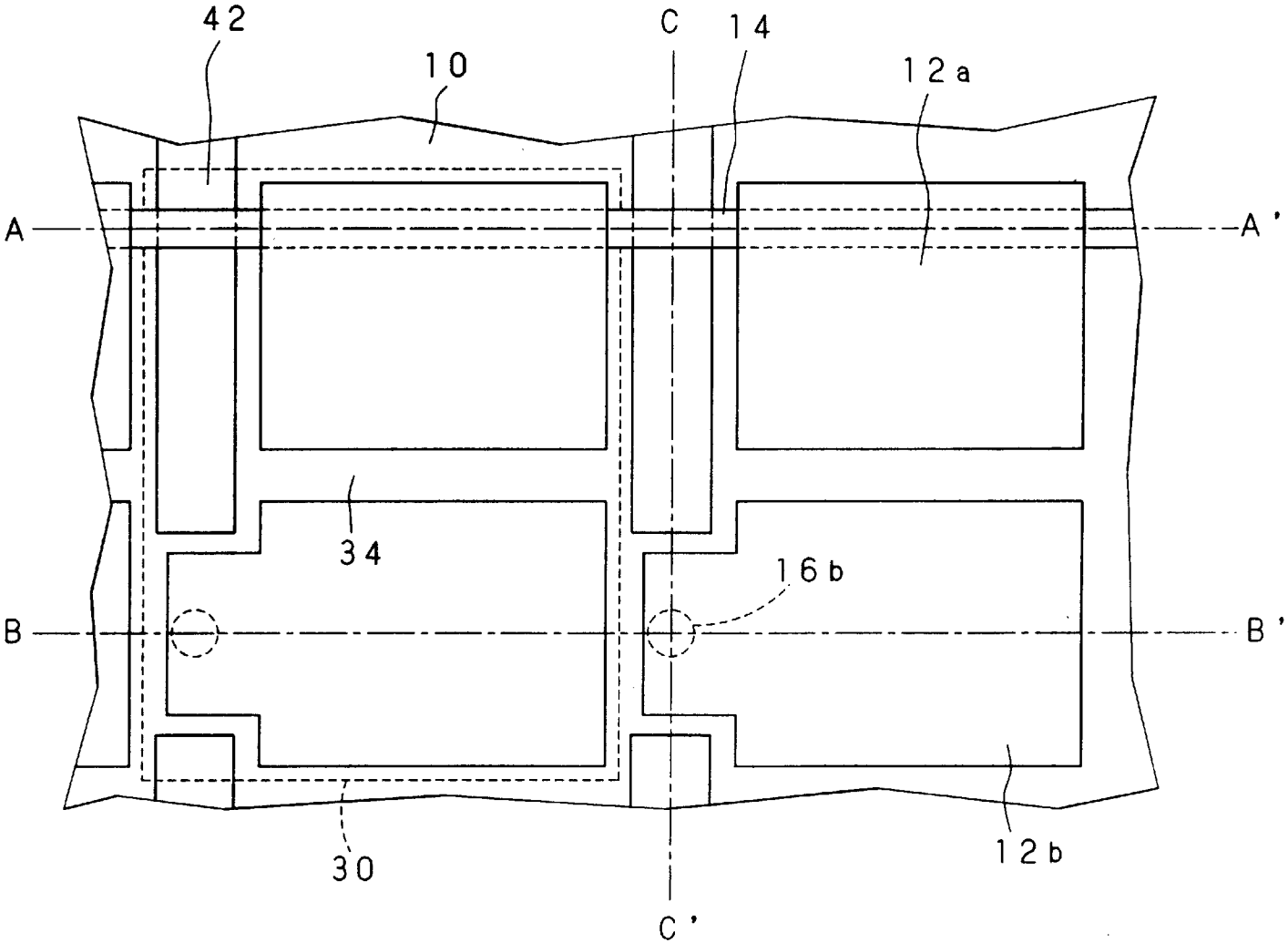
FIG. 6 is a plan view showing a structure of a plasma display panel according to the third embodiment of the present invention.
Figure 7:
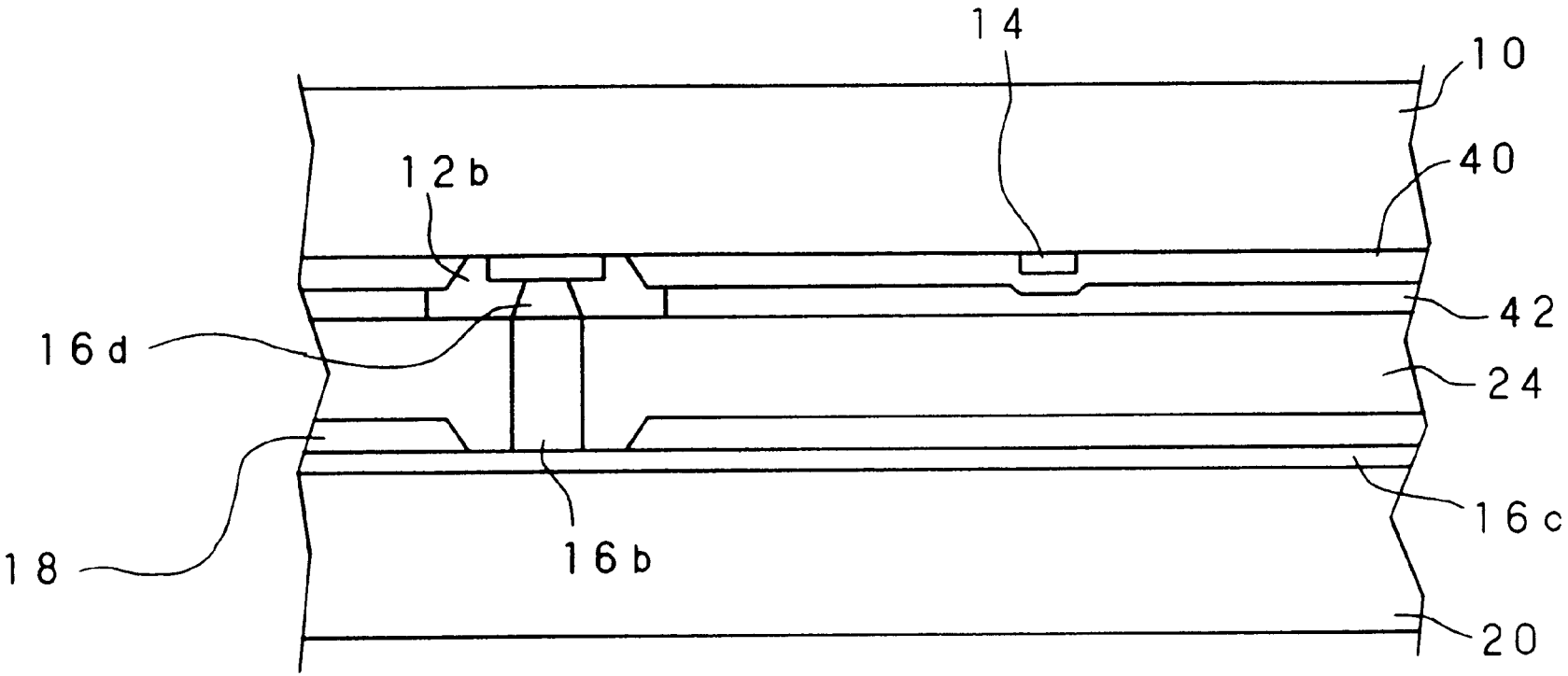
FIG. 7 is a cross-sectional view along the C–C' line of the third embodiment shown in FIG. 6.

A structure of a plasma display panel according to the third embodiment is shown in FIGS. 6 and 7. FIG. 6 is a plan view showing a structure of a plasma display panel according to the third embodiment of the present invention. FIG. 7 is a cross-sectional view along the C–C' line of the third embodiment shown in FIG. 6. The plasma display panel according to the third embodiment structurally differs from the plasma display panel according to the first embodiment in that the row discharge electrodes 12*b* are extended to a region where the separating wall 24 is formed in the discharge space 32 (see FIG. 2) side of the front substrate 10, and the connecting electrodes are removed. Thus, in the plasma display panel according to the third embodiment, since the transparent row discharge electrodes also play a role as the connecting electrode, and since it is not necessary to form a black mask around the connecting electrode, the portion corresponding to connecting electrode can be repaired.

In the above explanation, although the horizontal direction of the display panel is described as the line direction, the switching of the line direction and the row direction may yield the same effects.

It is possible to improve the brightness of the plasma display panel by using the transparent row discharge electrodes for the connecting electrodes which are originally opaque.

Figure 8:
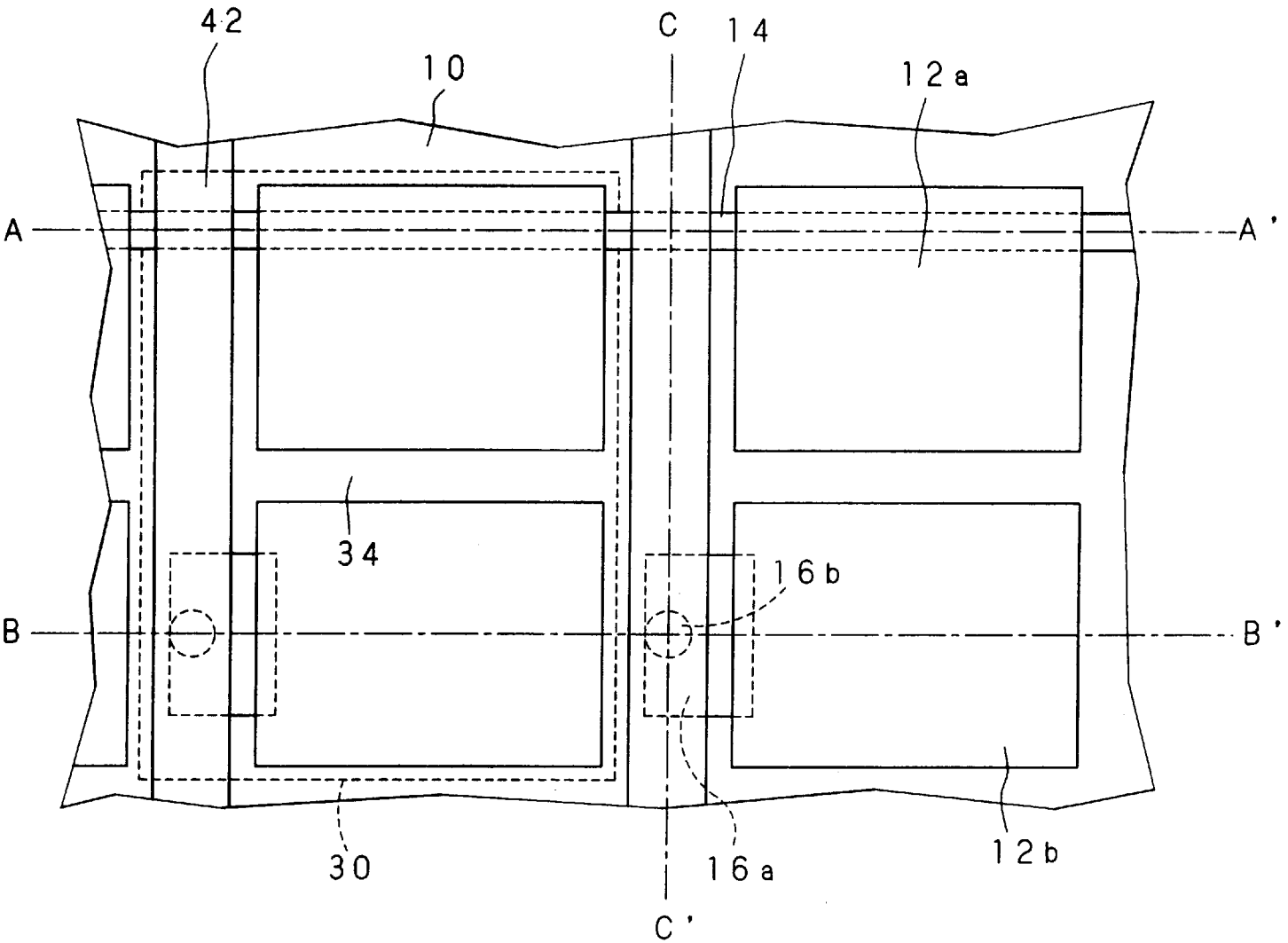
FIG. 8 is a plan view showing a structure of a plasma display panel according to the fourth embodiment of the present invention.

The structure of the plasma display panel according to the fourth embodiment of the present invention is shown in FIG. 8. FIG. 8 illustrates the plan view of the fourth embodiment of the present invention. The plasma display panel according to the fourth embodiment structurally differs from the plasma display panel according to the first embodiment in that the line bus wiring 14 and the connecting electrodes 16*a* are formed on the approximately identical plane. Except for this structure, the remaining structure is the same as that of the first embodiment, so that the same elements are denoted by the same numerals and their explanations are omitted.

In the plasma display panel according to the fourth embodiment, the line bus wiring 14 and the connecting electrodes 16*a* are formed on approximately the same plane, so that the line bus wiring 14 and the connecting electrodes 16*a* can be formed in the same manufacturing process, which results in reducing the number of manufacturing processes to less than the number of processes for manufacturing the first or the third embodiment.

The practical structure of the plasma display panel of the fourth embodiment is described hereinafter with reference to FIGS. 1 to 8. In these figures, on the front substrate 10, line discharge electrodes 12*a* and the row discharge electrodes 12*b* are formed leaving the surface discharge gap 34 by transparent electrode materials such as tin oxide (SnO2) or indium tin oxide (ITO). The above described line discharge electrodes 12*a* and row discharge electrodes 12*b* are formed independently for each display pixel (discharge cell), and respective line and row discharge electrodes are connected to each other by use of bus wiring 14, the connecting electrode 16*a,* the transfer electrodes 16*b,* and the row bus wiring 16*c,* which are made of low resistance materials such as metals.

In plasma display panels according to any one of the first to the fourth embodiments, line bus wiring 14 is formed in the horizontal direction, and the row bus wiring 16*c* is formed in the perpendicular direction. However, the row bus wiring 16*c* is formed under the separating walls before forming the separating walls 24. The line bus wiring 14 is formed by a multi-layered film of chrome/copper/chrome or aluminum thin film at a thickness of around 1 $\mu$m. The row discharge electrode 12*b* is connected to the connecting electrodes 16*a* using a conductive metal (for example silver) paste. The connecting electrodes 16*a* are formed at locations facing to each other in order to electrically connect to the transfer electrodes 16*b*.

Furthermore, in order to improve the contract of the display panel, the black mask 42 is formed by a mixture of a low-melting glass and a black pigment in the form of stripes at a thickness of 5 to 10 $\mu$m. When the black mask 42 is formed as a lattice rather than stripes, the plasma display panel showed an improved contrast, although the brightness decreases.

On the above described electrodes and the black mask 42, the transparent dielectric layer 40 is formed. This transparent dielectric layer 40 is formed as a dense and foam free layer at a thickness of 20 to 40 $\mu$m by re-flowing a layer of the paste mainly composed of a low-melting glass at a temperature higher than the softening temperature of the low-melting glass.

Furthermore, on the transparent dielectric layer, a protective layer 44 comprising magnesium oxide (MgO) is formed at a thickness of 0.5 to 1 $\mu$m. Since magnesium oxide is a material resistant to the discharge and a material having a high coefficient of secondary electron emission, the magnesium oxide layer is applied for stabilizing the discharge voltage and for lowering the discharge voltage.

As described above, a pair of surface discharge electrode 12*a* and 12*b* is formed for each discharge cell 30, and the line discharge electrode 12*a* and the row discharge electrode 12*b* extracted to form a matrix. Edges of the rectangular line discharge electrode 12*a* and the rectangular row discharge electrode 12*b* formed in a discharge cell 30, which is surrounded by the separating wall 24 and the black mask 42, are positioned leaving a space from the separating wall 24 and the black mask 42 by 20 to 150 $\mu$m inside the separating wall 24 and the black mask 42.

On the back substrate 20, the row bus wiring 16*c* in the form of stripes made of the silver paste is formed in the perpendicular direction at the thickness of 5 to 10 $\mu$m. Furthermore, the white dielectric layer 18 is formed under the separating wall 24. This white dielectric layer 18 reflects visible light emitted from the fluorescent material layer 22 to the forward direction, which allows efficient utilization of the emitted visible light.

The discharge space 32 is defined between the front substrate 10 and the back substrate 20 arranged facing the front substrate 10, and the separating walls 24 are formed in the perpendicular direction so as to separate display pixels in order to assure the withstanding voltage between the line bus wiring 14 and the row bus wiring 16*c*. The transfer electrodes 16*b* are formed together with the separating wall 24 by embedding the metal paste (silver) into a portion formed after patterning the dry film into the stripes by exposure and development and after embedding the separating wall paste in the pattern masking the portion opposing to the connecting electrode 16*a*. Further, the pad electrodes 16*d* are formed as the dotted pattern on the transfer electrodes 16*b*.

The separating wall 24 contributes to prevent discharge or optical cross talk between adjacent discharge cells. The separating wall 24 is normally formed in white separating walls in order to efficiently utilize the visible light emitted from the fluorescent material layer 22. On the white dielectric layer 18 formed between separating walls 24, fluorescent layers 22 corresponding to R, G, and B are coated in stripes. These fluorescent layers 22 emit blue to red visible light by the property of being excited by the ultraviolet light generated by the gas discharge. In order to obtain a high brightness, these fluorescent stripes are formed extending to the side surfaces of the separating walls.

Subsequently, the front substrate 10 and the back substrate 20 are assembled so as to face each other to form the discharge space (discharge cell) 30 and a mixture gas of He, Ne, and Xe are filled in the discharge space at a pressure of 0.5 to 0.7 atm. The periphery of both front and back substrates 10 and 20 are sealed tightly by a sealing material composed of a low-melting glass (not shown in the figure). The sealing material is coated on either one or both of the front and back substrates 10 and 20 by screen printing or by a dispenser. In the process of forming tight sealing by melting the low-melting glass, the pad electrode 16*d* is connected to the connecting electrode 16*a* by softening or melting the pad electrode 16*a*.

In the second embodiment of the present invention shown in FIG. 5, a transparent dielectric layer 50 is formed between the connecting electrode 12*a* and the transfer electrode 16*b*. The electrostatic capacity obtained by coupling this transparent dielectric layer in the above structure with the discharge gap is 100 times higher than the electrostatic capacity of the discharge gap 34 formed between the line electrode 12*a* and the row electrode 12*b* within a range of 60 to 100 $\mu$m. Thereby, the driving voltage is applied as a controllable driving waveform to the discharge gap 34 after allocating the driving voltage by the electrostatic capacity ratios of the transparent dielectric layer 50 and the discharge gap 34.

The plasma display panels according to the first to fourth embodiments of the present invention comprise a pair of surface discharge electrodes 12*a* and 12*b* independently formed in each discharge cell 30 and a matrix formed by the line bus wiring 14 and the row bus wiring 16*c*, which allow independently selecting a pair of surface discharge electrodes 12*a* and 12*b* constituting a discharge cell 30. In addition, since the line bus wiring 14 and the row bus wiring 16*c* cross each other enclosing the separating wall 24, the withstanding voltage therebetween becomes sufficiently high.

Figure 9:
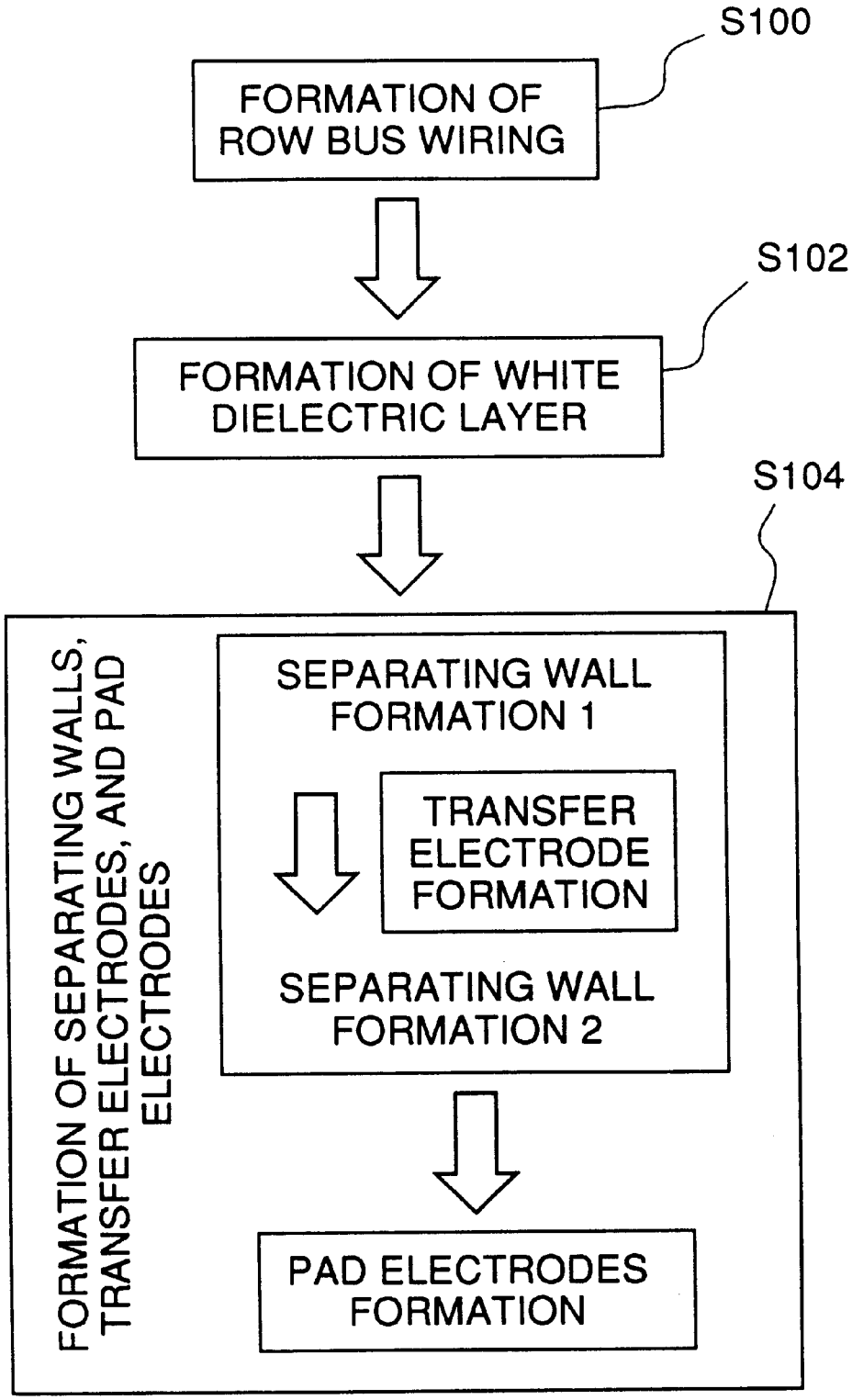
FIG. 9 is a flow chart showing method of forming electrodes on the back plate.
Figure 10A:
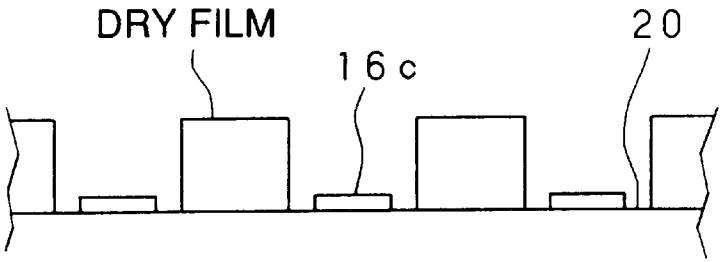
FIGS. 10A to 10D are model diagrams showing electrode forming process on the back plate.
Figure 10B:
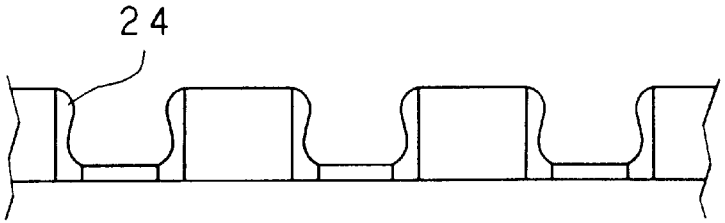
Figure 10C:
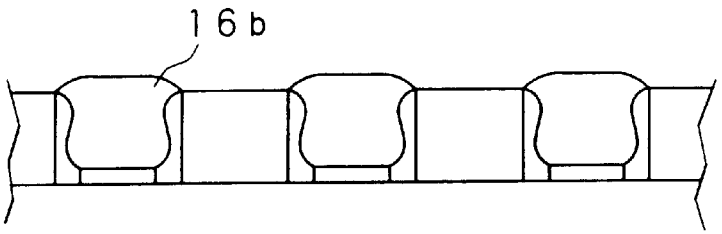

The methods of manufacturing plasma display panels will be explained hereinafter with reference to FIGS. 1 to 11. Here, FIG. 9 illustrates a flow chart of forming electrodes on the back substrate 20, FIG. 10 illustrates a schematic diagram showing the method of forming electrodes on the back substrate, and FIG. 11 illustrates a schematic diagram showing the method of forming electrodes on the front substrate. FIG. 10 is a cross-sectional diagram along the line B–B' in FIG. 1, which is a portion where the transfer electrodes are to be formed.

In FIG. 9, the line bus wiring 16*c* made of metal electrodes are formed in the form of stripes on the back substrate 20 by thin film technology or thick film technology. Thin film technology provides a patterned thin film shown in FIG. 10 (A) by photolithographic etching using as a dry film or a photosensitive resist a metal thin film made of Cr—Cu—Cr or aluminum formed at a thickness of 0.2 to 1.0 $\mu$m. In thick film technology, a patterned thick film is also obtained by similar etching or the photolithographic etching, or by exposure and development of a photosensitive thick film made of a photosensitive silver paste obtained by printing into a desired pattern (S100).

Next, the white dielectric layer 18 is formed by printing and firing a paste composed mainly of a white pigment and a low-melting glass into a pattern excluding an area for forming transfer electrodes 16*b* (S102).

Subsequently, in order to form the separating walls, a patterned dry film at a thickness in a range of 100 to 150 $\mu$m is formed in the form of stripes provided with an optimized dimension. A paste at a viscosity of 500 to 1500 centipoise for forming the separating wall is printed filling into the interval of these stripes. It is possible, as shown in FIG. 10(B), to selectively attach the separating wall paste to the side wall of the dry film when printing filling a separating wall paste having an appropriate viscosity selected in accordance with the height and width of the separating wall. It is also possible to fill up the separating wall paste by a dispenser. As shown in FIG. 10(C), after drying the paste, a silver paste is printed at the position for forming the transfer electrode 16*b* by use of a screen for printing the dot pattern. The other method of coating by a dispenser can be used.

Subsequently, a separating wall paste having 2,000 to 4,000 centipoises is printed by being filled into and drying on the transfer electrodes 16*b* formed by the dried silver paste by use of a screen having a broken line pattern for preventing attachment of the separating wall paste to the upper surface of the transfer electrode 16*b*. Subsequently, the above mentioned dry film is abraded and the transfer electrode 16*b* and the separating walls 25 in the form of surrounding the transfer electrodes 16*b* are formed after drying.

Figure 10D:
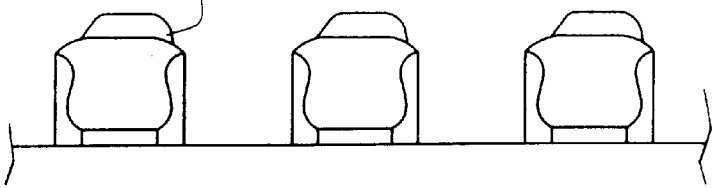
Figure 11:
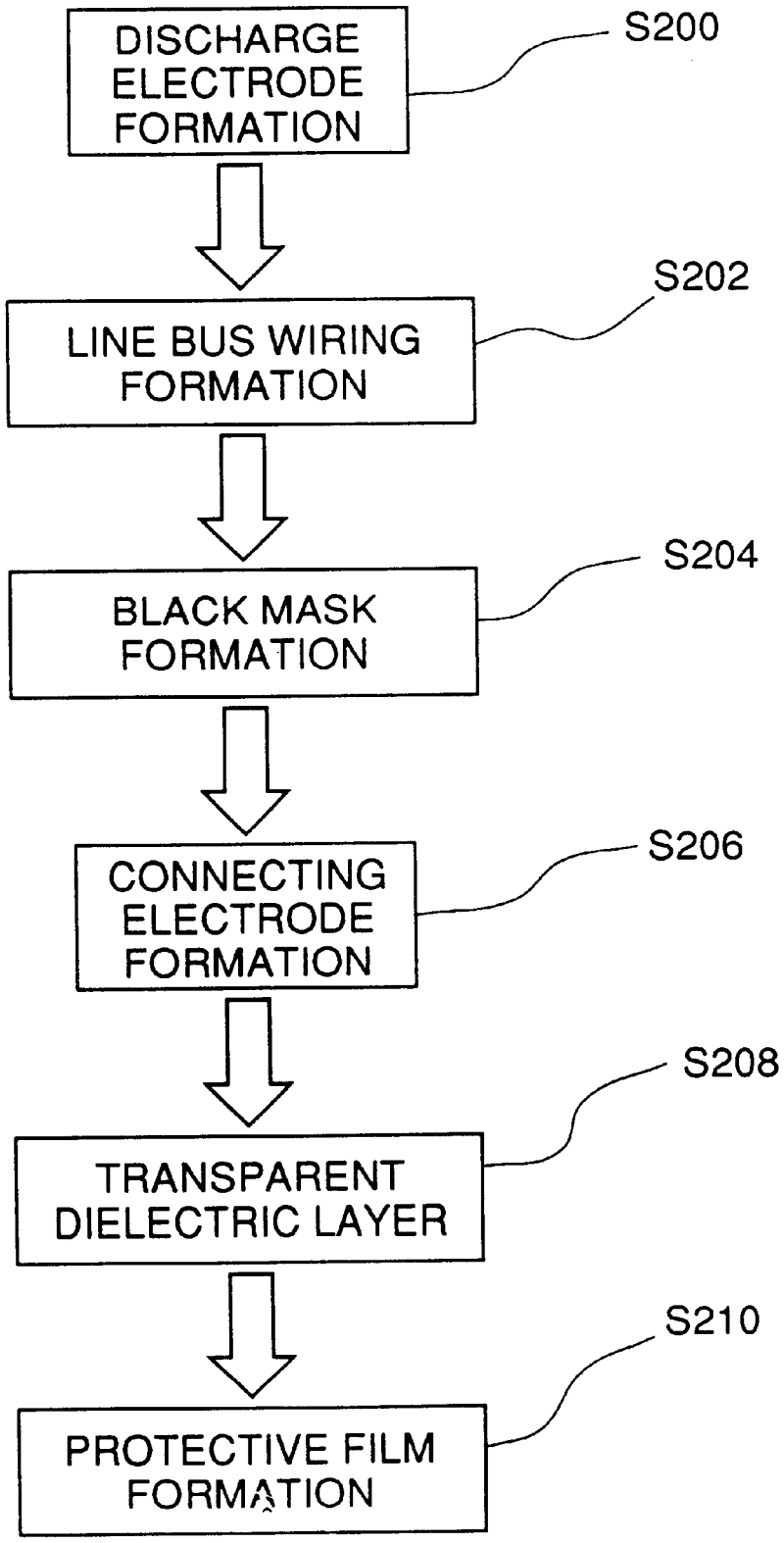
FIG. 11 is a flow chart showing method of forming electrodes on the front plate.
Figure 12:
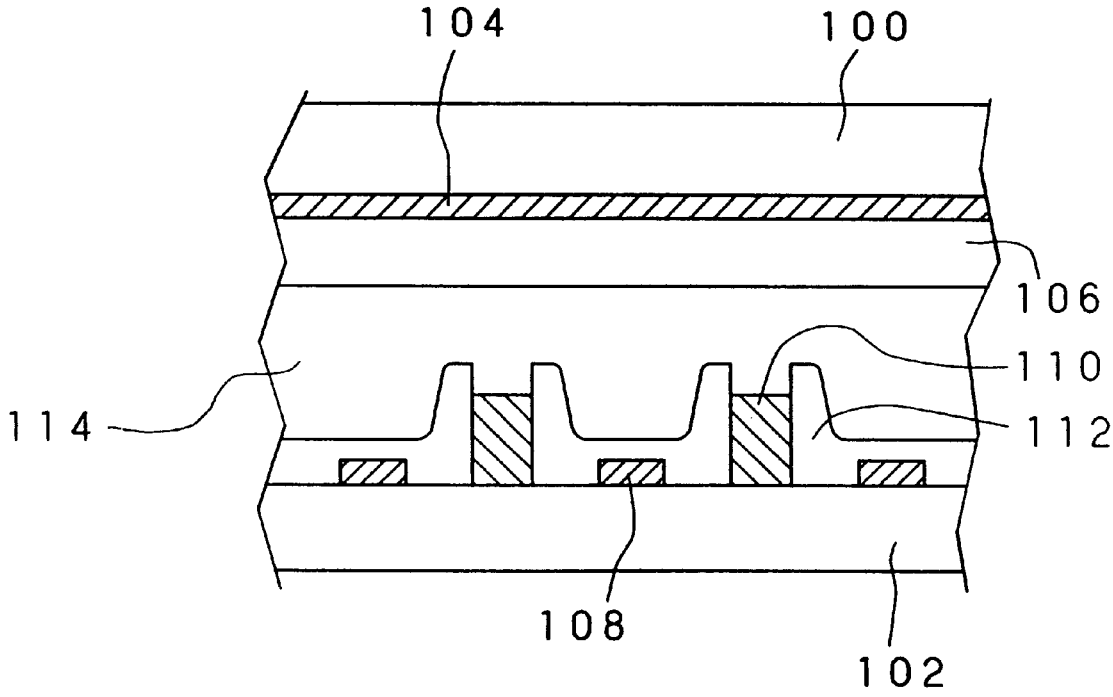
Fig. 12 PRIOR ART
FIG. 12 is a cross-sectional diagram showing a schematic structure of a conventional two electrode-type plasma display panel.
Figure 13:
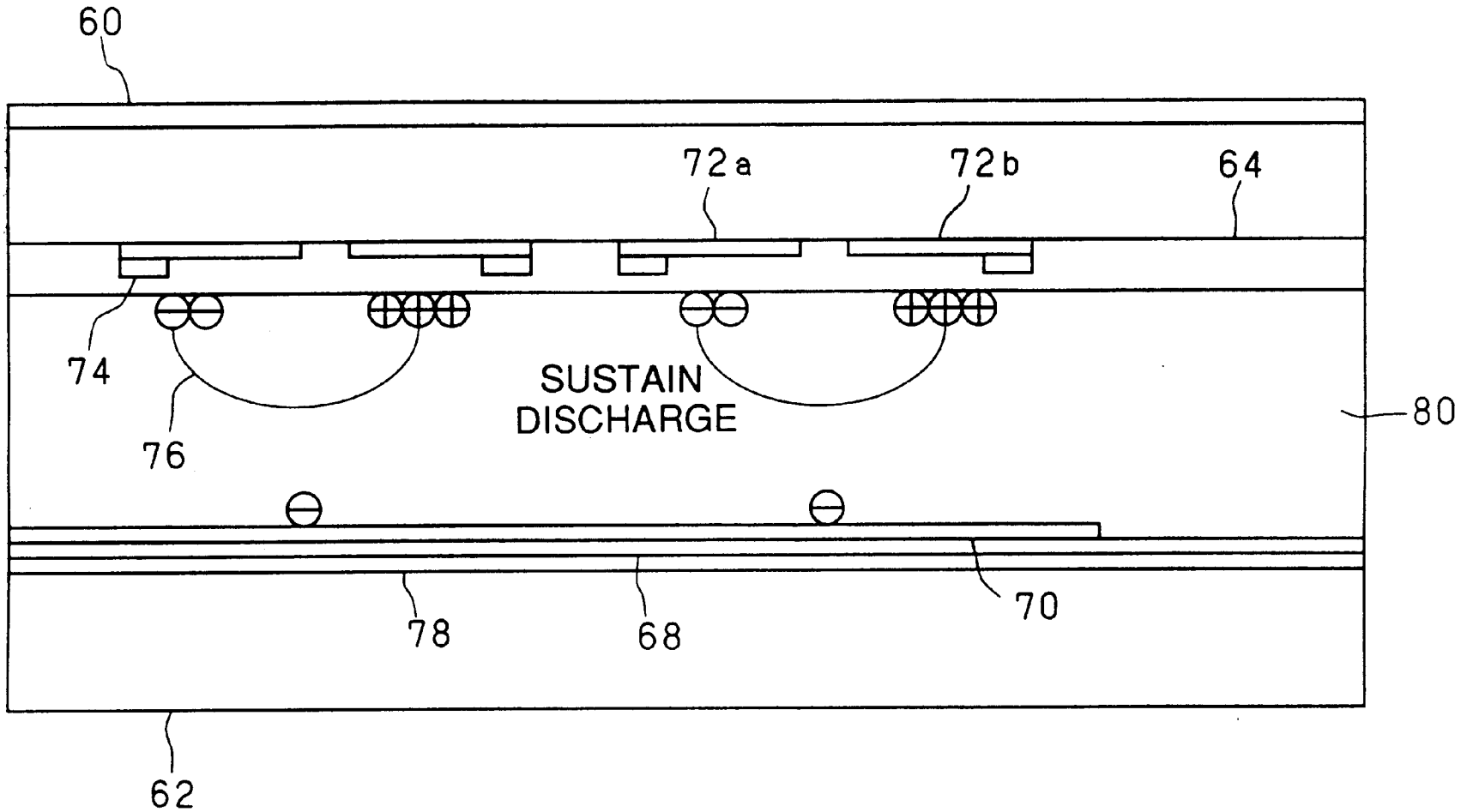
Fig. 13 PRIOR ART
FIG. 13 is a diagram showing a schematic structure of a conventional plasma display panel.

Furthermore, as shown in FIG. 10D, a silver paste is coated and dried in a dot like form on the transfer electrodes 16*b* by printing or by a dispenser for forming the pad electrodes 16*d*. Subsequently, the row bus wiring 16*c*, the transfer electrodes 16*b*, and the pad electrodes are fired simultaneously (S104). For the types of silver paste for forming the pad electrode, the silver paste having the meting temperature of 5 to 30° C. lower than that used for the transfer electrodes 16*b* is selected.

Next, a method for forming electrodes on the front substrate 10 is described with reference to FIG. 11. The transparent ITO or nesa film formed on the front substrate 10 is etched by photolithographic patterning into approximately rectangular shapes for forming line discharge electrodes 12*a* and the row discharge electrodes 12*b*. The transparent ITO or nesa film is deposited by vapor deposition or a sputtering method. Subsequently, the line bus wiring 14 is formed by thin film technology or thick film technology, which are similar to that used for forming the row bus electrode 16*c* (S202).

Subsequently, the black mask 42 is formed based on thick film technology. The black mask is formed by an additive method or by photolithographic method using a photosensitive paste. In the additive method, a paste composed of a low-melting glass, a black inorganic pigment, and an inorganic insulating material is filled into a gap of the patterned dry film and formed by sintering the paste after removing the dry film.

The method of producing the black mask by photolithography comprises forming a photosensitive film composed of a low-meting glass, a black inorganic pigment, and a inorganic insulating material by printing or the like, and patterning the photosensitive film by exposure and development, and sintering the patterned film (S204). Subsequently, the connecting electrodes 16*a* is formed by thick film technology comprising printing of the metal paste, and a photolithography using a photosensitive metal paste (S206). Subsequently, the transparent dielectric layer 40 is formed by printing a paste composed mainly of a low-melting glass. The printing is carried out using a screen so as to leave a part of the connecting electrode uncovered by the transparent dielectric layer 40 (S208).

Finally, the magnesium oxide (MgO) film is formed by vapor deposition or by the sputtering method as a protective film for covering the line discharge electrodes 12*a* and the row discharge electrodes 12*b* (S210).

The front substrate 10 and the back substrate 20 formed as described above are assembled by facing each other, and the periphery of the assembly is tightly sealed by re-melting and cooling the low-melting glass. At this time of this re-melting process, the pad electrode 16*d* is softened or melted such that the connecting electrode 16*a* is connected to the pad electrode 16*d*. For this purpose, a low-melting glass having softening temperature 5 to 50° C. lower than the softening temperature of the low-melting glass used for the sealing is used as an composition of the silver paste for forming the pad electrode.

According to the method of manufacturing the plasma display panel as described above, a combination of the conventional thin film technology and the conventional thick film technology makes it possible to form a matrix by the line bus wiring 14 and the row bus wiring 16*c* formed on different substrates. Thereby, it becomes possible to manufacture the plasma display device without particular facilities and at a high yield.

What is claimed is:

1. A plasma display panel comprising:

a first substrate comprising a plurality of surface discharge electrode pairs comprising a conductive material arranged so as to form a matrix;

a second substrate comprising separating walls and fluorescent material layers disposed so as to conform with said plurality of surface discharge electrode pairs;

a plurality of line bus wirings formed extending along a line direction on said first substrate; and a plurality of row bus wirings formed extending along a row direction on said second substrate, said row direction being essentially at a right angle with respect to said line direction, wherein electrodes of one side of each electrode pair in said plurality of surface discharge electrode pairs are connected to each line bus wire of said plurality of line bus wirings, and electrodes of the other side of each electrode pair in said plurality of surface discharge electrode pairs are connected to each row bus wire of said plurality of row bus wiring, wherein:

said separating wall comprises a wall portion extending at least along the row direction, said wall portion comprising at least one transfer electrode formed therein; and at least one electrode of said plurality of surface discharge electrode pairs is positioned on the other of said wall portion, and is connected with said row bus wire by a connecting means comprising said at least one transfer electrode formed in said separating wall.

2. The plasma display panel according to claim 1, wherein each surface discharge electrode of said surface discharge electrode pairs comprises at least two mutually opposing end sides disposed leaving a space from said separating wall.

3. The plasma display panel according to claim 1, wherein, in a direction along either the line direction or the row direction of said first substrate, said surface discharge electrode pair is partitioned by a black mask formed so as to intervene between an upper portion of the separating wall and said first substrate.

4. The plasma display panel according to claim 3, wherein each surface discharge electrode of said surface discharge electrode pairs comprises at least two mutually opposing end sides disposed leaving a space from said black mask.

5. The plasma display panel according to claim 2, wherein said space is within a range of 20 to 150 $\mu$m.

6. The plasma display panel according to claim 1, wherein separating walls are formed in the form of stripes on said second substrate, and fluorescent material layers are formed on an area of said second substrate between said separating walls and on at least a portion of side surfaces of said separating walls.

7. The plasma display panel according to claim 1, wherein:

said connecting means further comprises a connecting electrode formed on said first substrate and connected to said at least one electrode of said plurality of surface discharge electrode pairs; and said transfer electrode is formed on said second substrate and connected to said transfer electrode.

8. The plasma display panel according to claim 7, further comprising a plurality of connecting means, wherein a pad electrode pattern is formed on each transfer electrode or on each connecting electrode, and wherein said pad electrode pattern is a layer composed of a material which can be melted and deformed simultaneously during an airtight sealing process of said first substrate and said second substrate.

9. The plasma display panel according to claim 7, wherein said connecting electrode and said transfer electrode are coupled by a dielectric layer.

10. The plasma display panel according to claim 9, wherein said dielectric layer has an electrostatic capacity 100 times larger than that of a space between an electrode of the one side and an electrode of the other side of said surface discharge electrode pair.

11. The plasma display panel according to claim 1, wherein said first substrate and said second substrate are transparent insulating substrates.

12. The plasma display panel according to claim 1, wherein a pad electrode pattern is formed on said transfer electrode.

* * * * *